US008151806B2

(12) United States Patent
Wanna

(10) Patent No.: US 8,151,806 B2
(45) Date of Patent: Apr. 10, 2012

(54) SMOKING ARTICLES HAVING REDUCED ANALYTE LEVELS AND PROCESS FOR MAKING SAME

(75) Inventor: Joseph T. Wanna, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 827 days.

(21) Appl. No.: 11/052,454

(22) Filed: Feb. 7, 2005

(65) Prior Publication Data

US 2006/0174904 A1 Aug. 10, 2006

(51) Int. Cl.
*A24D 1/00* (2006.01)
*A24D 1/10* (2006.01)

(52) U.S. Cl. ..... 131/365; 131/219; 131/343

(58) Field of Classification Search ..... 131/331, 131/334, 345, 360, 365, 284, 338, 343, 219
See application file for complete search history.

(56) References Cited

U.S. PATENT DOCUMENTS

| | | | |
|---|---|---|---|
| 1,996,002 | A | 3/1935 | Seaman |
| 2,003,690 | A | 6/1935 | Lewton |
| 2,013,508 | A | 9/1935 | Seaman |
| 2,116,544 | A | 5/1938 | Schur |
| 2,673,799 | A | 3/1954 | Schur et al. |
| 2,776,912 | A | 1/1957 | Gregory |
| 3,146,159 | A | 8/1964 | Muggleton |
| 3,215,579 | A | 11/1965 | Hagen |
| 3,353,541 | A | 11/1967 | Hind et al. |
| 3,386,449 | A | 6/1968 | Hind |
| 3,415,253 | A | 12/1968 | Michaels et al. |
| 3,420,241 | A | 1/1969 | Hind et al. |
| 3,428,053 | A | 2/1969 | Schoenbaum et al. |
| 3,467,109 | A | 9/1969 | Block et al. |
| 3,472,237 | A | 10/1969 | Stephens |
| 3,483,874 | A | 12/1969 | Hind |
| 3,511,247 | A | 5/1970 | Tamol |
| 3,526,904 | A | 9/1970 | Tamol |
| 3,561,451 | A | 2/1971 | Jacin et al. |
| 3,599,153 | A | 8/1971 | Lewis et al. |
| 3,620,801 | A | 11/1971 | O'Grady |
| 3,621,851 | A | 11/1971 | Heskett et al. |

(Continued)

FOREIGN PATENT DOCUMENTS

| | | | |
|---|---|---|---|
| CA | 2319855 | A1 | 3/2000 |

(Continued)

OTHER PUBLICATIONS

Product Data Sheet for Mapico® High-Purity Synthetic Iron Oxide Yellow 1135, Aug. 16, 2001.

(Continued)

*Primary Examiner* — Matthew Daniels
*Assistant Examiner* — Jodi F Cohen
(74) *Attorney, Agent, or Firm* — Dority & Manning, P.A.

(57) ABSTRACT

Smoking articles having reduced Hoffmann analytes contained in the mainstream smoke is disclosed. In one embodiment, an alginate composition is applied to a wrapper that is incorporated into a smoking article. The alginate composition causes a significant reduction in at least certain of the Hoffmann analytes that are generated when the smoking article is smoked. The alginate composition may be applied so as to cover a substantial portion of the surface area of the wrapper in one embodiment. In another embodiment, the alginate composition is applied as a single band to the paper wrapper so to cover a substantial portion of the distal end of the smoking article.

24 Claims, 1 Drawing Sheet

U.S. PATENT DOCUMENTS 3,699,973 A 10/1972 Tamol et al.
3,736,940 A 6/1973 Saint-Pastou
3,760,815 A 9/1973 Deszyck
3,805,799 A 4/1974 Stewart et al.
3,847,164 A 11/1974 Mattina et al.
3,860,012 A 1/1975 Selke
3,911,932 A 10/1975 Houck, Jr. et al.
3,943,762 A 3/1976 Baer
3,949,762 A 4/1976 West et al.
4,077,414 A 3/1978 Baker et al.
4,129,134 A 12/1978 Hind et al.
4,140,760 A 2/1979 Withington
4,146,040 A 3/1979 Cohn
4,182,349 A 1/1980 Selke
4,193,412 A 3/1980 Heim et al.
4,222,740 A 9/1980 Bohrn et al.
4,239,591 A 12/1980 Blake
4,267,240 A 5/1981 Jaisle et al.
4,303,084 A 12/1981 Simon
4,351,638 A 9/1982 Finlayson, III et al.
4,386,108 A 5/1983 Richter
4,452,259 A 6/1984 Norman et al.
4,453,553 A 6/1984 Cohn
4,481,960 A 11/1984 Brooks
4,489,738 A 12/1984 Simon
4,543,370 A 9/1985 Porter et al.
4,590,955 A 5/1986 Dixit
4,607,647 A 8/1986 Dashley et al.
4,615,345 A 10/1986 Durocher
4,622,983 A 11/1986 Mathews et al.
4,665,648 A 5/1987 Kahn
4,674,519 A 6/1987 Keritsis et al.
4,679,575 A 7/1987 Yamaguchi et al.
4,739,775 A 4/1988 Hampl, Jr.
4,784,164 A 11/1988 Adams et al.
4,805,644 A 2/1989 Hampl, Jr. et al.
4,880,870 A 11/1989 Zimmermann et al.
4,889,145 A 12/1989 Adams et al.
4,928,715 A 5/1990 Mentzel et al.
4,945,932 A 8/1990 Mentzel et al.
4,984,589 A 1/1991 Riedesser
4,998,542 A 3/1991 Kallianos et al.
5,040,551 A 8/1991 Schlatter et al.
5,057,606 A 10/1991 Garbe
5,060,675 A 10/1991 Milford et al.
5,092,353 A 3/1992 Montoya et al.
5,106,417 A 4/1992 Hauser et al.
5,131,416 A 7/1992 Gentry
5,143,099 A 9/1992 Le Gars et al.
5,144,966 A 9/1992 Washington
5,161,549 A * 11/1992 Rosario ..... 131/331
5,170,807 A 12/1992 Kasbo et al.
5,178,167 A 1/1993 Riggs et al.
5,220,930 A * 6/1993 Gentry ..... 131/365
5,221,502 A 6/1993 Washington
5,261,425 A 11/1993 Raker et al.
5,263,999 A 11/1993 Baldwin et al.
5,271,419 A 12/1993 Arzonico et al.
5,316,575 A 5/1994 Lent et al.
5,393,333 A 2/1995 Trouve
5,417,228 A 5/1995 Baldwin et al.
5,450,862 A 9/1995 Baldwin et al.
5,450,863 A 9/1995 Collins
5,474,095 A 12/1995 Allen et al.
5,500,191 A 3/1996 DeMatte
5,503,876 A 4/1996 Fields et al.
5,523,014 A 6/1996 Dolan et al.
5,540,242 A * 7/1996 Chao et al. ..... 131/365
5,690,787 A 11/1997 Hultman et al.
5,715,844 A 2/1998 Young et al.
5,722,433 A 3/1998 Ishino et al.
5,724,998 A 3/1998 Gellatly et al.
5,765,570 A 6/1998 Litzinger et al.
5,820,998 A * 10/1998 Hotaling et al. ..... 428/533
5,849,153 A 12/1998 Ishino et al.
5,878,753 A 3/1999 Peterson et al.
5,878,754 A 3/1999 Peterson et al.
5,893,372 A 4/1999 Hampl, Jr.
6,095,152 A 8/2000 Beven et al.
6,129,087 A 10/2000 Wallace et al.
6,286,516 B1 9/2001 Bowen et al.
6,289,898 B1 * 9/2001 Fournier et al. ..... 131/365
6,298,860 B1 10/2001 Hampl et al.
6,305,382 B1 10/2001 Hampl, Jr.
6,314,964 B1 * 11/2001 Hampl, Jr. ..... 131/365
6,371,127 B1 * 4/2002 Snaidr et al. ..... 131/198.1
6,415,798 B1 7/2002 Hersh et al.
6,568,403 B2 5/2003 Hampl, Jr. et al.
6,606,999 B2 8/2003 Crooks et al.
6,615,842 B1 * 9/2003 Cerami et al. ..... 131/331
6,637,439 B2 10/2003 Hajaligol et al.
6,645,605 B2 11/2003 Hammersmith et al.
6,679,270 B2 1/2004 Baskevitch et al.
6,701,936 B2 3/2004 Shafer et al.
6,705,325 B1 3/2004 Hicks et al.
6,722,373 B2 4/2004 Bowen et al.
6,725,867 B2 4/2004 Peterson et al.
6,748,955 B2 6/2004 Snaidr et al.
6,769,437 B2 8/2004 Hajaligol et al.
6,779,530 B2 8/2004 Kraker
6,799,578 B2 10/2004 Snaidr et al.
6,810,884 B2 11/2004 Snaidr et al.
6,823,872 B2 11/2004 Hampl, Jr.
6,827,087 B2 12/2004 Wanna et al.
6,837,248 B2 1/2005 Zawadzki et al.
6,854,469 B1 2/2005 Hancock et al.
6,860,274 B2 3/2005 Matsufuji et al.
6,929,013 B2 8/2005 Ashcraft et al.
7,017,586 B2 3/2006 Tsutsumi et al.
7,165,553 B2 1/2007 Luan et al.
7,219,672 B2 5/2007 Tosas Fuentes et al.
7,234,471 B2 6/2007 Fitzgerald et al.
7,308,898 B2 12/2007 Monsalud, Jr. et al.
2002/0000235 A1 * 1/2002 Shafer et al. ..... 131/361
2002/0062834 A1 5/2002 Snaidr et al.
2002/0139381 A1 * 10/2002 Peterson et al. ..... 131/365
2002/0179103 A1 12/2002 Hersh et al.
2002/0179105 A1 12/2002 Zawadzki et al.
2002/0179106 A1 12/2002 Zawadzki et al.
2002/0189625 A1 12/2002 Bushby et al.
2003/0041867 A1 3/2003 Hajaligol et al.
2003/0131860 A1 7/2003 Ashcraft et al.
2003/0136420 A1 * 7/2003 Kraker ..... 131/360
2003/0145869 A1 8/2003 Kitao et al.
2003/0150466 A1 8/2003 Kitao
2003/0164173 A1 9/2003 Zawadzki et al.
2004/0007242 A1 1/2004 Finlay et al.
2004/0011368 A1 1/2004 Tsutsumi et al.
2004/0011369 A1 1/2004 Matsufuji et al.
2004/0020502 A1 2/2004 Tosas Fuentes et al.
2004/0020504 A1 2/2004 Snaidr et al.
2004/0094171 A1 5/2004 Wanna et al.
2004/0123874 A1 7/2004 Zawadzki et al.
2004/0134631 A1 7/2004 Crooks et al.
2004/0177856 A1 9/2004 Monsalud, Jr. et al.
2004/0255966 A1 12/2004 Kraker
2005/0005947 A1 1/2005 Hampl et al.
2005/0016556 A1 1/2005 Ashcraft et al.
2005/0056294 A1 3/2005 Wanna et al.
2005/0076929 A1 4/2005 Fitzgerald et al.
2007/0084475 A1 4/2007 Oglesby
2007/0137668 A1 6/2007 Borschke et al.
2007/0246055 A1 10/2007 Oglesby
2008/0115794 A1 5/2008 Oglesby

FOREIGN PATENT DOCUMENTS

DE 10146810 A1 4/2003
EP 0193607 B1 9/1986
EP 0231664 A1 8/1987
EP 0290911 A2 11/1988
EP 0386884 A2 9/1990
EP 0419975 A2 4/1991
EP 0419975 A3 4/1991
EP 0458522 11/1991
EP 0458526 A1 11/1991
EP 0486213 A1 5/1992
EP 0601933 A2 6/1994

| | | | |
|---|---|---|---|
| EP | 0671505 | A2 | 9/1995 |
| EP | 0864259 | A2 | 9/1998 |
| EP | 0870437 | A2 | 10/1998 |
| EP | 1084629 | A1 | 3/2001 |
| EP | 1417899 | A1 | 5/2004 |
| FR | 2470598 | A1 | 6/1981 |
| FR | 2548675 | A1 | 1/1985 |
| GB | 848332 | | 9/1960 |
| GB | 903067 | | 9/1965 |
| GB | 2100572 | | 1/1983 |
| WO | 81/02243 | A1 | 8/1981 |
| WO | 88/01478 | A1 | 3/1988 |
| WO | 91/14729 | | 10/1991 |
| WO | 98/16125 | A1 | 4/1998 |
| WO | 99/53778 | A2 | 10/1999 |
| WO | 00/11976 | A1 | 3/2000 |
| WO | WO 0141590 | A1 | 6/2001 |
| WO | 02/37991 | A1 | 5/2002 |
| WO | 02/43513 | A1 | 6/2002 |
| WO | WO 02067704 | A1 | 9/2002 |
| WO | WO 02078471 | A1 | 10/2002 |
| WO | WO 03034845 | A1 | 5/2003 |
| WO | WO 03064165 | A1 | 8/2003 |
| WO | 03/088771 | A1 | 10/2003 |
| WO | WO 03/092416 | A1 | 11/2003 |

OTHER PUBLICATIONS

Annex to Form PCT/ISA/206 for PCT/US2004/013656, Dec. 22, 2004.

Hoffmann, Dietrich and Hoffmann, Ilse (1997), The Changing Cigarette, 1950-1995, Mar. 1997, Journal of Toxicology and Environmental Health, Part A, 50:4, 307-364 (DOI: 10.1080/009841097160393) URL: http://dx.doi.org/10.1080/009841097160393.

MacEvoy, Bruce, Synthetic Inorganic Pigments, Jul. 2008, www.handprint.com/HP/WCL/pigmt1b.ntml, accessed Nov. 16, 2010.

Pulp and Paper Chemistry and Chemical Technology, third Edition, vol. III by James P. Casey—Editor—A Wiley-Interscience Publication—pp. 1507-1521 & pp. 1702-1703, date :1981.

Kimberly-Clark, Product List of Cigarette Papers, 5 pages (Nov. 13, 1993).

Ecusta, Standard Products Catalog of Cigarette Papers, 3 pages (Apr. 15, 1987).

Publication, "Relative Ignition Propensity of Test Market Cigarettes", Richard G. Gann, et al., National Institute of Standards and Technology, Technology Administration, U.S. Department of Commerce, Jan. 2001.

Publication, "The Effect of Cigarette Characteristics on the Ignition of Soft Furnishings", Richard G. Gann, et al., Center for Fire Research National Bureau of Standards, Oct. 1987.

Publication, "Overview: Practicability of Developing a Performance Standard to Reduce Cigarette Ignition Propensity", U.S. Consumer Product Safety Commission, Aug. 1993.

Publication, "Cigarette Ignition Performance", J.T. Wanna and P.X. Chen, Journal of Fire Sciences, vol. 19, Sep./Oct. 2001, pp. 355-368.

German Standard, DIN ISO 2965, Materials used as cigarette papers, filter plug wrap and filter joining paper, including materials having an oriented permeable zone—Determination of air permeability, Jan. 2000, 19 pages.

* cited by examiner

SMOKING ARTICLES HAVING REDUCED ANALYTE LEVELS AND PROCESS FOR MAKING SAME

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as calcium carbonate.

When a smoking article is smoked, mainstream smoke is generated that is inhaled through the filter. Mainstream smoke can contain numerous different components that provide the smoking article with a particular taste, which encompasses the sensations detected not only by one's taste but also by one's sense of smell. In order to provide a smoking article with a particular taste, as many as over 500 different ingredients may be added to the tobacco at different levels. In addition to the components of mainstream smoke that contribute to the taste of the smoking article, the mainstream smoke can also contain various other analytes. For example, D. Hoffmann of the American Health Foundation recognized 44 different analytes that may be present in mainstream smoke. These analytes are typically referred to as "Hoffmann analytes" and include, for instance, ammonia, aminonaphthalenes, benzopyrene, formaldehyde, acetaldehyde, acetone, methyl ethyl ketone, butyraldehyde, hydrogen cyanide, nitrous oxides, tobacco-specific nitrosamines ("TSNAs"), pyridine, quinoline, hydroquinone, phenol, cresols, tar, nicotine, carbon monoxide, 1,3-butadiene, isoprene, acrylonitrile, benzene, toluene, styrene, and various others.

It has been determined that some Hoffmann analytes may be unwanted in the mainstream smoke from a smoking article. As such, extensive research has been conducted on reducing Hoffmann analytes.

Besides being used to hold smoking articles together, wrapping papers also contribute to and control many physical properties and characteristics of the smoking article. For instance, cigarette wrapping papers affect the rate at which the cigarette burns, the number of puffs per cigarette, tar, various volatile analytes, and the total tar delivery per puff. What is needed, however, is a cigarette wrapping paper that may additionally be used to reduce the amount of at least one Hoffmann analyte in the mainstream smoke of a smoking article.

SUMMARY OF THE INVENTION

In general, the present invention is directed to a method for reducing at least one Hoffmann analyte in the mainstream smoke of a smoking article and is directed to smoking articles made by the above methods. More particularly, the present invention is directed to a wrapping paper for smoking articles that is treated with a chemical composition that has been found to reduce the amount of Hoffmann analytes in mainstream smoke.

For example, in one embodiment, the present disclosure is directed to a smoking article comprising a column of a smokeable tobacco. The column of the smokeable tobacco is surrounded by a paper wrapper. In accordance with the present invention, the paper wrapper includes areas where an alginate composition is present. The alginate composition is present in an amount sufficient to reduce at least one Hoffmann analyte in a mainstream smoke generated by the smoking article when ignited.

In the past, alginate materials have been applied to paper wrappers for smoking articles in order to produce smoking articles having reduced ignition proclivity, which refers to the tendency of the smoking article to ignite surfaces which come into contact with the smoking article when lit. Using alginate compositions for reducing the ignition proclivity of smoking articles is disclosed, for instance, in U.S. Pat. No. 5,820,998 and in U.S. Pat. No. 6,779,530, which are both incorporated herein by reference. When applied for the purpose of reducing ignition proclivity, alginate compositions are typically applied to form treated discrete areas on the wrapping paper, such as in the form of circular bands.

In comparison to reducing ignition proclivity, the process of the present invention is directed to reducing at least one Hoffmann analyte contained in the mainstream smoke. Thus, the alginate composition may be applied using different techniques and in a different manner. For instance, instead of forming circular bands, the alginate composition may be applied in a uniform manner over substantially the entire surface area of the wrapping paper. Also, in some applications, lesser amounts of the alginate composition may be required in order to reduce Hoffmann analytes as opposed to when the alginate composition is used for reduced ignition proclivity.

In other applications, when an alginate composition is applied to a paper wrapper for reducing Hoffmann analytes, the alginate composition may, in some embodiments, not significantly affect the permeability of the paper wrapper. For instance, the permeability of the paper wrapper may be reduced by no more than about 60%, such as by no more than 50%. For example, the permeability of the paper wrapper may be reduced by no more than about 40%, such as by no more than 30%, such as by no more than 20%, or by no more than 10% in areas where the alginate composition is present.

Thus, the permeability of the paper wrapper in the areas where the alginate composition is applied according to the present invention may be greater than about 25 Coresta, such as greater than about 30 Coresta, such as greater than 35 Coresta or even greater than 40 Coresta. The alginate composition may be applied to the paper wrapper, for instance, in an amount from about 0.25% to about 10% by weight. For instance, in some embodiments, the alginate composition may be present in an amount from about 0.75% to about 5% by weight, while in other applications the alginate composition may be present in an amount from about 5% to about 8% by weight.

The alginate composition that is applied according to the present invention can vary depending upon the particular application. For instance, the alginate composition may comprise a sodium alginate, a potassium alginate, an ammonium alginate, mixtures thereof, and the like. The alginate composition may have any suitable molecular weight or viscosity.

The alginate composition may be incorporated into the paper wrapper using various techniques. For example, in one embodiment, the alginate composition may be topically applied to the paper wrapper. For instance, the alginate composition may be applied using a size press during production of the paper wrapper. Alternatively, the alginate composition may be topically applied to the paper wrapper after the wrapper has been formed. In these embodiments, for instance, a printing device may be used in order to apply the alginate, such as a rotogravure printing device, a flexographic printing device, and the like. In still other embodiments, the alginate composition may be sprayed onto the paper wrapper.

Instead of being topically applied to the paper wrapper, the alginate composition may also be otherwise incorporated into the paper wrapper. For instance, in one embodiment, the alginate composition may be combined with an aqueous suspension of fibers which are then used to form the paper wrapper.

Once an alginate composition is applied to a paper wrapper in accordance with the present invention, smoking articles made from the paper wrapper have been found to exhibit significant reductions in certain Hoffmann analyte levels in the mainstream smoke. For instance, it is believed that the alginate composition can reduce formaldehyde contained in the mainstream smoke by at least 10%, such as by at least 15%. Aminonaphthalenes contained in the mainstream smoke may be reduced by at least 3%, such as at least 5%, and, in one embodiment, by at least 10%. Ammonia contained in the mainstream smoke may be reduced by at least 10%, such as by at least 20%. Nitrous oxides may be reduced in the mainstream smoke by at least 10%, such as at least 15%, or at least 20%. Hydrogen cyanide levels in the mainstream smoke may be reduced by at least about 2%, such as by at least about 5%. In addition to the above, tobacco-specific nitrosamines may be reduced by at least 3%, such as by at least 5%, or by at least 10% in the mainstream smoke. Still other Hoffmann analytes that may be reduced according to the present invention in mainstream smoke include acrolein, other carbonyls, and aromatic amines.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
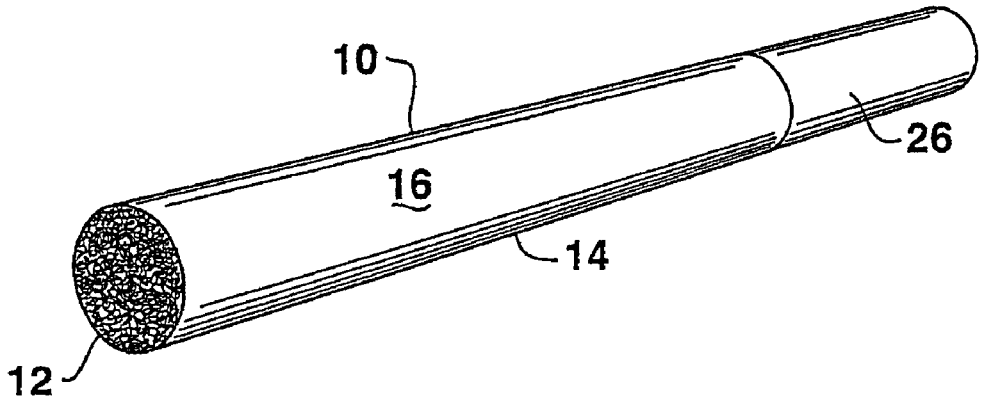
FIG. 1 is a perspective view of a smoking article made in accordance with the present invention.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present invention is directed to wrappers for smoking articles that are particularly designed to reduce at least one Hoffmann analyte in the mainstream smoke of the smoking article. The present disclosure is also directed to various methods for producing the wrappers. In one embodiment, for instance, the present invention is directed to incorporating an alginate composition into the wrapper in a manner that causes a reduction in certain Hoffmann analyte compounds in the smoke produced by a smoking article made with the wrapper. For example, reductions have been observed in certain carbonyls, such as formaldehyde, acetaldehyde, acrolein, and the like, in certain aromatic amines such as aminonaphthalenes, in nitrous oxides, and in ammonia. Of particular advantage, alginates can be incorporated into wrappers in accordance with the present invention without substantially affecting any other properties of the wrapper or the taste and appearance of the smoking article.

For purposes of explanation, the embodiments and principles of the invention will be discussed in regards to a cigarette. However, this is for purposes of explanation of the invention only and is not meant to limit the invention only to cigarettes. Any manner of smoking article is within the scope and spirit of the invention. For instance, it is believed that the principles of the present invention also apply to cigars and the like.

In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In the past, alginates have been used to form bands or other discrete areas on cigarette wrapping papers in order to decrease the ignition proclivity characteristics of a smoking article incorporating the wrapper. For example, such wrapping papers are disclosed in U.S. Pat. No. 5,820,998, in U.S. Pat. No. 5,878,753, in U.S. Pat. No. 6,568,403, in U.S. Pat. No. 6,725,867, and in U.S. Pat. No. 6,779,530, which are all incorporated herein by reference.

As mentioned above, the above patents relate to using alginates for forming smoking articles having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the fabric, burn its entire length without igniting the fabric, or self-extinguish before igniting the test fabric or burning its entire length.

Another test for ignition proclivity is referred to as the "Cigarette Extinction Test". In the Cigarette Extinction Test, a lit cigarette is placed on one or more layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In general, smoking articles having reduced ignition proclivity are made by applying the alginate in discrete areas in amounts sufficient so that the smoking article will pass one of the above tests. As described in U.S. Pat. No. 5,820,998, in the past, alginates have been applied to the discrete areas in amounts that cause a substantial reduction in the permeability of the paper. For example, as stated in U.S. Pat. No. 5,820,998, the permeability of the paper coated with the alginate is generally at least about 75% less than the permeability of an identical uncoated portion of the paper.

According to the present invention, on the other hand, an alginate composition is applied to a paper wrapper in order to primarily reduce the amount of Hoffmann analytes contained in the mainstream smoke of a smoking article. In this regard, in order to maximize Hoffmann analyte reduction, alginates may be applied in different amounts and/or in a different manner in comparison to many prior art products that incorporated alginates for reduced ignition proclivity characteristics. For example, according to the present invention, instead of being applied to paper wrappers in spaced-apart areas such as bands, an alginate composition may be applied to a paper wrapper according to the present invention so as to substantially cover the entire surface area of the paper wrapper. For instance, the alginate composition may be applied so as to cover over 60% of the surface area of the paper wrapper, such as over 70%, such as over 80%, and even over 90% of the surface area of the paper wrapper.

When topically applied to the paper wrapper, the alginate composition may be applied continuously or discontinuously. When applied discontinuously, for instance, the alginate composition may appear as a pattern that includes untreated areas on the paper wrapper. The untreated areas on the paper wrapper, however, may amount to a small portion of the overall surface area of the paper wrapper.

Alginate compositions may also be incorporated into paper wrappers according to the present invention in a manner so as to not significantly interfere with the properties of the wrapper. For example, in comparison to many prior art products where alginate compositions were used to reduce ignition proclivity characteristics, alginate compositions may be applied to wrappers according to the present invention without substantially decreasing the permeability of the wrapper. For example, alginate compositions may be applied to paper wrappers according to the present invention in amounts such that the permeability of the paper wrapper decreases by no more than about 60%, such as no more than about 50%, such as by no more than about 40%, and, in one embodiment, may be applied so as to decrease the permeability by no more than about 30%. Of particular advantage, it is believed that relatively low amounts of an alginate composition may be applied to the wrapper and still be effective in reducing at least one Hoffmann analyte of a mainstream smoke of a smoking article incorporating the wrapper.

Paper wrappers made according to the present invention are capable of reducing various Hoffmann analytes in the mainstream smoke generated by a smoking article incorporating the wrapper. Currently, there are 44 different Hoffmann analytes that are associated with mainstream cigarette smoke. Hoffmann analytes that may be reduced according to the present invention include ammonia, aminonaphthalenes, aminobiphenyl, benzopyrenes, formaldehyde, acetaldehyde, acetone, acrolein, propionaldehyde, crotonaldehyde, methyl ethyl ketone, butyraldehyde, hydrogen cyanide, nitrous oxides, nitrosamines such as tobacco-specific nitrosamines, hydroquinone, resorcinol, catechol, phenol, cresols, tar, nicotine, carbon monoxide, butadienes, isoprene, acrylonitrile, benzene, toluene, and the like. Depending upon the particular component, the Hoffmann analyte may be reduced by at least 2%, such as at least 5%, such as at least 10%, such as at least 15%, and in some applications, by at least 20% based upon the total amount of the component per smoking article or cigarette.

Formaldehyde levels, for instance, may be reduced by at least 5%, such as at least 10%, or at least 15%. Aminonaphthalenes may be reduced by at least 3%, such as at least 5%. Nitrous oxides may be reduced by greater than 10%, such as greater than about 20%. Hydrogen cyanide has been found to be reduced by at least about 2%, such as at least by about 5%. Ammonia may be reduced by at least about 15%, such as at least about 20%, and, in one embodiment, by at least about 25%. Of particular advantage, all of the above reductions may occur without the alginate composition affecting the taste of the smoking article or substantially interfering with any of the properties of the wrapper.

Figure 2:
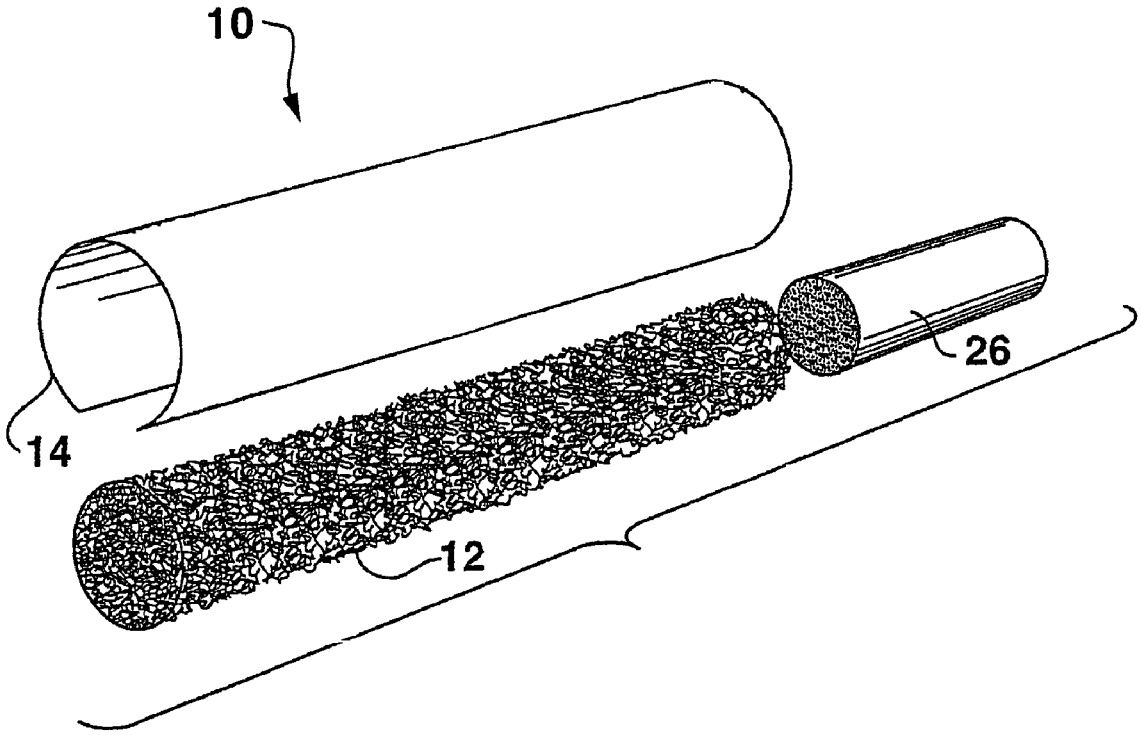
FIG. 2 is an exploded view of the smoking article illustrated in FIG. 1.

In order to assist in describing and explaining the present invention in more detail, one embodiment of a smoking article made in accordance with the present invention is illustrated in FIGS. 1 and 2. The smoking article 10 includes a tobacco column 12 within a wrapper 14 made in accordance with the present invention. The smoking article 10 may include a filter 26. The filter 26 may be enclosed by a tipping paper that can also be used to attach the filter to the smoking article.

Generally, the wrapping paper 14 can be made from cellulosic fibers obtained, for instance, from flax, soft wood, or hard wood. In order to vary the properties of the paper as desired, various mixtures of cellulosic fibers can be used. The extent to which the fibers are refined can also be varied.

For most applications, the paper wrapper 14 contains a filler. The filler can be, for instance, calcium carbonate, magnesium oxide, or any other suitable material. The total filler loading added to the paper wrapper can be between about 10% to about 40% by weight.

The permeability of the paper wrapper 14 can generally be from about 10 Coresta units to about 200 Coresta units. In some applications, for instance, the permeability can be from about 15 Coresta units to about 110 Coresta units. In one particular embodiment, for instance, the permeability of the paper wrapper prior to applying the alginate composition can be from about 60 Coresta units to about 110 Coresta units, such as from about 80 Coresta units to about 100 Coresta units.

The basis weight of the wrapping paper 14 may be between about 15 gsm to about 60 gsm, and more particularly between about 18 gsm to about 40 gsm.

The wrapping paper 14 may be treated with a burn control additive, which may also serve as an ash conditioner. Such burn control additives can include, for instance, alkali metal salts, acetates, phosphate salts or mixtures thereof. A particularly preferred burn control additive is a mixture of potassium citrate and sodium citrate. The burn control additive can be added to the paper wrapper in an amount from about 0.3% to about 5% by weight, and more particularly from about 0.3% to about 2.5% by weight.

The paper wrapper 14 defines an outer circumferential surface 16 when wrapped around the tobacco column 12. In accordance with the present invention, an alginate composition is incorporated into the paper wrapper 14 for reducing Hoffmann analytes contained in the mainstream smoke produced by the smoking article 10. The alginate composition may be incorporated into the paper wrapper 14 using various methods and techniques. In fact, it is believed that the alginate composition may be incorporated into the paper wrapper at any stage during the production of the paper wrapper.

In one embodiment, for instance, an alginate composition may be combined with an aqueous slurry of fibers that is used to produce the paper wrapper 14. The alginate composition may be combined with the aqueous suspension of fibers in an amount sufficient so that a desired amount of alginate remains in the paper once it is formed for reducing Hoffmann analytes. In general, any suitable alginate may be used in accordance with the present invention. The alginate may be, for instance, a sodium alginate or a potassium alginate. In other embodiments, an ammonium alginate, a propylene glycol alginate, and the like may be used. Further, it should be understood that mixtures of different types of alginates may be used.

Suitable salts and/or derivatives of alginic acid may be obtained, for instance, from ISP Corporation. Exemplary products include, for instance, KELGIN MV which is a granular refined sodium alginate having a mesh size of about 30. A 1% solution of KELGIN MV has a viscosity of about 400 centipoise at 25° C. as measured using a Brookfield LVF viscometer. A 2% solution of KELGIN MV has a viscosity of about 6000 centipoise at 25° C. as measured using a Brookfield LVF viscometer.

In addition to KELGIN MV, KELGIN LV may also be used. KELGIN LV has a lower viscosity than KELGIN MV.

Other commercially available alginates that may be used in accordance with the present invention include KELGIN LB, KELGIN RL, MANUCOL LD and MANUCOL LB, which are all also commercially available from the ISP Corporation. The above alginates generally have a viscosity of less than about 500 centipoise when contained in a 3% by weight aqueous solution at 25° C. For instance, the alginates can have a viscosity of less than about 250 centipoise at the above conditions, particularly less than 100 centipoise, and in one embodiment at a viscosity of about 20 to 60 centipoise.

In addition to combining an alginate composition with an aqueous suspension of fibers in forming the paper wrapper, in other embodiments, the alginate composition may be applied topically to the paper wrapper. For example, in one embodiment, the alginate composition can be applied to the paper wrapper as the paper wrapper is being formed. If the paper wrapper is made according to a wetlaid papermaking process, the alginate composition may be applied to the wrapper prior to the wrapper being dried or after the wrapper has been dried. For example, in one embodiment, the alginate composition may be applied to the paper wrapper using a size press during production of the paper wrapper. The size press, for instance, may comprise a bath in which the paper wrapper is dipped, a spray device, or a roll that is dipped into a bath containing an alginate composition for application to the paper wrapper.

In still other embodiments, the alginate composition may be applied to the paper wrapper in an offline process after the wrapper is formed. In this embodiment, for instance, the alginate composition may be sprayed or printed onto the paper wrapper. Any suitable printing technique may be used including flexographic printing, offset rotogravure printing, and the like.

When topically applying the alginate composition to the paper wrapper, in one embodiment, lower viscosity alginate compositions may be used. For example, lower viscosity alginate compositions can be formed at higher solids content but yet at a low enough solution viscosity to permit the application of the composition to a paper wrapper using conventional printing and spraying techniques. For example, the solids content of an alginate solution can be greater than about 6%, particularly greater than about 10%, and more particularly from about 10% to about 20% by weight while still having a solution viscosity of greater than about 250 centipoise, particularly greater than about 500 centipoise, and more particularly greater than about 800 centipoise. For example, in one embodiment, the alginate composition that is applied to the paper wrapper may have a viscosity of greater than about 1000 centipoise at 25° C.

In general, alginate compositions that are topically applied to the paper wrapper can contain alginate and water. Although not necessary, other ingredients may also be included within the composition. For instance, in one embodiment, a filler can be contained within the composition. The filler can be, for instance, calcium carbonate, calcium chloride, calcium lactate, calcium gluconate, and the like. In addition to calcium compounds, other metal oxides can also be included.

In still other embodiments, the alginate composition can be combined with a burn promoter such as a citrate and/or MAP. The alginate composition can also contain other organic or inorganic type salts, such as sodium or potassium salts of acidic, malic, maleic acid, chloride, phosphate, and the like.

When the alginate composition is applied topically, in one embodiment, the alginate composition is applied so as to cover a substantial portion of the surface area of the paper wrapper. For example, in various embodiments, the alginate composition may be applied so as to cover at least 70%, such as at least 80%, such as at least 90%, and, in one embodiment, at least 95% of the surface area of the paper wrapper. The alginate composition may be applied as a continuous coating or as a discontinuous coating. When applied as a discontinuous coating, the alginate composition may be applied according to any suitable pattern as long as the desired amount of surface area of the paper wrapper is covered. Further, when using various printing techniques, such as rotogravure printing, the alginate composition is applied as small droplets that may leave untreated areas on the paper wrapper. For example, rotogravure printers include gravure cells which hold a small amount of the composition and which is released in a pattern either directly onto the paper wrapper or onto a rubber applicator roll. The pattern substantially covers the entire surface area of the paper wrapper but may leave small areas of untreated portions. These untreated portions may be desirable in some applications.

In one embodiment of the present invention, the alginate composition is applied only to the distal end of the smoking article. In particular, it is believed that certain Hoffmann analytes are produced during initial ignition and during the first few puffs taken from the smoking article. Thus, sufficient Hoffmann analyte reduction may occur if a single band is placed at the distal end of the paper wrapper when placed on a smoking article. In this embodiment, for instance, the band may start substantially at the distal end of the paper wrapper and extend so as to cover at least about 30% of the surface area of the wrapper, such as at least about 50% of the surface area of the wrapper.

In contrast to when alginate compositions are used for reducing the ignition proclivity characteristics of a smoking article, alginate compositions applied according to the present invention can reduce Hoffmann analytes without substantially affecting any other properties of the paper wrapper. In fact, paper wrappers treated with an alginate composition according to the present invention may fail the Mock-Up Ignition Test and the Cigarette Extinction Test. Further, the alginate composition when applied according to the present invention should either have no substantial impact on the permeability of the wrapping paper or is used so that the permeability falls within desired limits for freeburning cigarettes.

In general, the alginate composition may be applied according to the present invention in amounts up to about 10% by weight. For example, the alginate composition may be applied in an amount from about 0.1% to about 8% by weight. The amount of the alginate composition applied to the paper wrapper will generally depend upon the desired results and various other factors. For example, in one embodiment, the alginate composition may be applied in an amount from about 0.25% to about 5% by weight, such as from about 0.75% to about 3% by weight. In other embodiments, however, greater amounts may be applied, such as from about 5% to about 8% by weight.

In one embodiment, the permeability of the paper wrapper may be reduced by no more than about 50%, such as no more than about 40%, and, in one embodiment, by no more than 30% when the alginate composition is applied or otherwise incorporated into the wrapper. The permeability of the paper wrapper after being treated with the alginate composition, for instance, may be from about 25 Coresta to about 55 Coresta, such as from about 30 Coresta to about 50 Coresta. In one embodiment, for instance, the paper wrapper may have an initial permeability of greater than about 60 Coresta, such as greater than about 80 Coresta. Once treated with an alginate composition in accordance with the present invention, however, the paper wrapper may have a resulting permeability of from about 25 Coresta to about 55 Coresta, such as from about 30 Coresta to about 40 Coresta.

It should be understood that paper wrappers made according to the present invention may also contain discrete areas or bands that reduce the ignition proclivity characteristics of the smoking article. For instance, in one embodiment, an alginate composition may be applied according to the present invention so as to cover a substantial portion of the surface area of the paper wrapper. A film-forming composition, such as a cellulose composition or an alginate composition, may also be applied to the paper wrapper to form discrete areas or bands that reduce the ignition proclivity characteristics of the present invention. The bands or treated discrete areas may have a width so that oxygen is limited to the burning coal for a sufficient length or period of time to extinguish the coal if the smoking article were left on an adjacent surface. For instance, when applied in the form of bands, the bands may have a width of at least about 3 mm, such as from about 4 mm to about 10 mm. The bands can then be spaced apart so as to have a band spacing of between 5 and 50 mm. Within the treated discrete areas or bands, the paper wrapper may have a Burn Mode Index, as described in U.S. Pat. No. 4,739,775, of generally less than about 8 $cm^{-1}$, and particularly from 0 to about 5 $cm^{-1}$. For instance, in one embodiment, the Burn Mode Index of the treated areas can be from about 1 $cm^{-1}$ to about 3 $cm^{-1}$.

The treated discrete areas used for reducing the ignition proclivity characteristics of the smoking article can be formed from various materials. In particular, any suitable film-forming material may be used, such as an alginate, guar gum, pectin, polyvinyl alcohol, cellulosic materials, cellulose derivatives such as ethyl cellulose, methyl cellulose, carboxymethyl cellulose, starch, starch derivatives, mixtures thereof, and the like.

The present invention may be better understood with reference to the following example.

Example

The following example is provided for exemplary purposes in order to demonstrate that an alginate composition applied to a paper wrapper can reduce Hoffmann analytes in mainstream smoke generated by a smoking article incorporating the wrapper.

A cigarette was constructed that contained a paper wrapper having a basis weight of 28 and a permeability of 80 CORESTA. The paper wrapper included bands that were 6 mm wide and spaced 20 mm apart along the length of the wrapper. The bands were formed from an alginate composition. The alginate composition contained KELGIN LP alginate obtained from the ISP Corporation. The bands were applied to the wrapper in order to reduce the ignition proclivity characteristics of the cigarette.

The cigarette was placed in a smoking machine that was set to have a puff volume of 35 mL at 60-second intervals. The mainstream smoke was collected and tested for various Hoffmann analytes. A control cigarette was similarly tested. The control cigarette contained a similar paper wrapper, but was not treated with alginate composition bands. The following results were obtained:

| Tobacco Constituent | Sample ID Unit | Control Average | Sample No. 1 Average |
|---|---|---|---|
| Ammonia | (μg/cig) | 19.3 | 15.2 |
| 1-aminonaphthalene | (ng/cig) | 21.6 | 19.1 |
| 2-aminonaphthalene | (ng/cig) | 13.1 | 11.7 |
| 3-aminobiphenyl | (ng/cig) | 2.81 | 2.57 |
| 4-aminobiphenyl | (ng/cig) | 2.36 | 2.24 |
| Benzo[a]pyrene | (ng/cig) | 7.48 | 6.48 |
| Formaldehyde | (μg/cig) | 27.7 | 24.6 |
| Acetaldehyde | (μg/cig) | 490 | 457 |
| Acetone | (μg/cig) | 222 | 216 |
| Acrolein | (μg/cig) | 54.8 | 47.7 |
| Propionaldeyde | (μg/cig) | 43.5 | 40.6 |
| Crotonaldehyde | (μg/cig) | 15.3 | 13.4 |
| Methyl ethyl ketone | (μg/cig) | 54.7 | 53.6 |
| Butyraldehyde | (μg/cig) | 28.3 | 25.3 |
| Hydrogen Cyanide | (μg/cig) | 113 | 107 |
| NO | (μg/cig) | 188 | 143 |
| NOx | (μg/cig) | 191 | 145 |
| Nitrosonornicotine (NNN) | (ng/cig) | 112 | 93.5 |
| Nitrosoanatabine (NAT) | (ng/cig) | 115 | 90.4 |
| Nitrosoanabasine (NAB) | (ng/cig) | 15.9 | 12.5 |
| 4-(N-nitrosomethylamino)-1-(3-pyridyl)-1-butanone (NNK) | (ng/cig) | 74.5 | 60.1 |
| Pyridine | (μg/cig) | 13.3 | 13.1 |
| Quinoline | (μg/cig) | 0.373 | 0.333 |
| Hydroquinone | (μg/cig) | 49.1 | 47.4 |
| Resorcinol | (μg/cig) | 1.18 | 1.10 |
| Catechol | (μg/cig) | 49.1 | 49.3 |
| Phenol | (μg/cig) | 12.9 | 12.6 |
| m + p-cresols | (μg/cig) | 9.34 | 9.23 |
| o-cresol | (μg/cig) | 3.29 | 3.25 |
| Carbon Monoxide | (mg/cig) | 10.8 | 10.4 |
| 1,3-butadiene | (μg/cig) | 40.1 | 35.3 |
| Isoprene | (μg/cig) | 423 | 364 |
| Acrylonitrile | (μg/cig) | 9.64 | 7.88 |
| Benzene | (μg/cig) | 40.2 | 36.4 |
| Toluene | (μg/cig) | 76.7 | 67.1 |
| Styrene | (μg/cig) | 8.85 | 8.87 |

As shown above, the amount of Hoffmann analytes contained in the mainstream smoke of Sample No. 1 was significantly lower than the amount of Hoffmann analytes contained in the mainstream smoke of the Control. The above test was completed simply to demonstrate that an alginate composition has the ability to reduce Hoffmann analytes. The present inventors believe that further reductions in certain of the Hoffmann analytes may result if the alginate composition is applied differently than in bands according to Sample No. 1.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A smoking article comprising:

a column comprising a smokeable tobacco; and a paper wrapper surrounding the column of the smokeable tobacco, the paper wrapper including a single continuous coating of an alginate composition, the continuous coating covering at least 90% of the surface area of the paper wrapper, the alginate composition being present in an amount sufficient to reduce at least one Hoffmann analyte in a mainstream smoke generated by the smoking article when ignited, the alginate composition reducing the permeability of the paper wrapper by no more than 30% in certain areas and wherein the permeability of the paper wrapper prior to applying the alginate composition is greater than about 60 Coresta units and wherein the permeability of the paper wrapper where the continuous coating of the alginate composition is located is greater than 40 Coresta.

2. A smoking article as defined in claim 1, wherein the alginate composition comprises sodium alginate.

3. A smoking article as defined in claim 1, wherein the alginate composition comprises potassium alginate.

4. A smoking article as defined in claim 1, wherein the alginate composition has been topically applied to the paper wrapper.

5. A smoking article as defined in claim 1, wherein the alginate composition is applied to the paper wrapper in an amount from about 0.25% to about 10% by weight.

6. A smoking article as defined in claim 1, wherein the alginate composition is applied to the paper wrapper in an amount from about 0.75% to about 5% by weight.

7. A smoking article as defined in claim 1, wherein the alginate composition is applied to the paper wrapper in an amount from about 5% to about 8% by weight.

8. A smoking article as defined in claim 1, wherein the smoking article further includes discrete bands on the paper wrapper comprised of a film-forming composition.

9. A smoking article as defined in claim 8, wherein the discrete bands have a width of at least 3 mm and a band spacing of from about 5 mm to about 50 mm.

10. A smoking article as defined in claim 8, wherein the discrete bands have a width of from about 4 mm to about 10 mm.

11. A smoking article as defined in claim 8, wherein the film-forming composition that comprises the discrete bands comprises an alginate, guar gum, pectin, polyvinyl alcohol, a cellulose derivative, a starch, a starch derivative, or mixtures thereof.

12. A smoking article as defined in claim 8, wherein the paper wrapper within the discrete bands has a Burn Mode Index of from 0 to about 5 $cm^{-1}$.

13. A smoking article as defined in claim 1, wherein the at least one Hoffmann analyte comprises formaldehyde, the formaldehyde being reduced by at least 10% in the mainstream smoke.

14. A smoking article as defined in claim 1, wherein the at least one Hoffmann analyte comprises an aminonaphthalene, the aminonaphthalene being reduced by at least 5% in the mainstream smoke.

15. A smoking article as defined in claim 1, wherein the at least one Hoffmann analyte comprises a nitrous oxide, the nitrous oxide being reduced by at least 10% in the mainstream smoke.

16. A smoking article as defined in claim 1, wherein the at least one Hoffmann analyte comprises hydrogen cyanide, the hydrogen cyanide being reduced by at least 2% in the mainstream smoke.

17. A smoking article as defined in claim 1, wherein the at least one Hoffmann analyte comprises ammonia, the ammonia being reduced by at least 10% in the mainstream smoke.

18. A smoking article as defined in claim 1, wherein the alginate composition reduces the permeability of the paper wrapper by no more than 20%.

19. A smoking article as defined in claim 1, wherein the alginate composition reduces the permeability of the paper wrapper by no more than 10%.

20. A paper wrapper for a smoking article comprising:

a paper wrapper for surrounding a column of a smokeable tobacco, the paper wrapper including a single continuous coating of an alginate composition, the continuous coating covering at least 90% of the surface area of the paper wrapper, the alginate composition being present in an amount sufficient to reduce at least one Hoffmann analyte in a mainstream smoke generated by the smoking article when ignited, the alginate composition reducing the permeability of the paper wrapper by no more than 30%, the permeability of the paper wrapper where the alginate composition has been applied being greater than 40 Coresta units, and wherein the permeability of the paper wrapper prior to applying the alginate composition is greater than about 60 Coresta units.

21. The smoking article as defined in claim 1, wherein the alginate composition covers at least 95% of the surface area of the paper wrapper.

22. The paper wrapper as defined in claim 20, wherein the alginate composition covers at least 95% of the surface area of the paper wrapper.

23. A paper wrapper as defined in claim 20, wherein the smoking article further includes discrete bands on the paper wrapper comprised of a film-forming composition.

24. A paper wrapper as defined in claim 23, wherein the film-forming composition that comprises the discrete bands comprises an alginate, guar gum, pectin, polyvinyl alcohol, a cellulose derivative, a starch, a starch derivative, or mixtures thereof.

* * * * *